US007470327B2

(12) United States Patent
Ooshima et al.

(10) Patent No.: US 7,470,327 B2
(45) Date of Patent: Dec. 30, 2008

(54) COATING ROD AND PRODUCING METHOD THEREFOR

(75) Inventors: Atsushi Ooshima, Shizuoka (JP); Satoru Matsumoto, Shizuoka (JP); Yasuhito Naruse, Shizuoka (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 10/952,786

(22) Filed: Sep. 30, 2004

(65) Prior Publication Data

US 2005/0109272 A1 May 26, 2005

(30) Foreign Application Priority Data

Oct. 2, 2003 (JP) ..... 2003-344815

(51) Int. Cl.
*B05C 1/08* (2006.01)

(52) U.S. Cl. ..... 118/123; 118/110; 118/118; 118/211; 118/244; 118/258; 118/414; 492/37

(58) Field of Classification Search ..... 118/110, 118/117, 118, 126, 414, 123, 211, 244, 258; 162/281; 15/256.52; 101/157, 169, 120, 101/457, 459; 427/356; 492/37
See application file for complete search history.

(56) References Cited

U.S. PATENT DOCUMENTS 4,426,757 A * 1/1984 Hourticolon et al. ..... 226/193
6,666,807 B2 * 12/2003 Codet et al. ..... 492/59

FOREIGN PATENT DOCUMENTS

| | | | |
|---|---|---|---|
| JP | 06118557 A | * | 4/1994 |
| JP | 08257601 A | * | 10/1996 |
| JP | 09-001032 A | | 1/1997 |
| JP | 2001-000901 A | | 1/2001 |
| JP | 2001-087697 A | | 4/2001 |

* cited by examiner

*Primary Examiner*—Laura Edwards
(74) *Attorney, Agent, or Firm*—Birch, Stewart, Kolasch & Birch, LLP

(57) ABSTRACT

A peripheral surface of a coating rod has an area where grooves (convex portions) are formed. This area is ground by a grinding apparatus by which a maximum height Ry of the rod surface is adjusted to 15 μm or less. Further, a ratio of D/W is adjusted to 0.01 or more, wherein D is a total distance of the convex portions of the rod actually abutting on a web in an axial direction of the rod, and W is a coating width of the web. Furthermore, straightness of the rod is adjusted to 30 μm or less per 1 m, and roundness of the rod is adjusted to 10 μm or less. Micro-projections are removed by grinding so that scratches of a coating surface are prevented from occurring. Coating unevenness is prevented by improving the straightness and the roundness.

1 Claim, 4 Drawing Sheets

COATING ROD AND PRODUCING METHOD THEREFOR

This Non-provisional application claims priority under 35 U.S.C. § 119(a) on Pat. application No(s). 2003-344815 filed in Japan on Oct. 2, 2003, the entire contents of which are hereby incorporated by reference.

BACKGROUND OF THE INVENTION

1. Field of the Invention

The present invention relates to a coating rod and a producing method therefor, and in particular relates to a coating rod for coating various kinds of liquid substance (coating liquid) on a material to be coated (hereinafter called as web), and for smoothing the liquid substance after coating. The material to be coated is a thin metal plate, a paper, a film and so forth having a sheet shape or a web shape.

2. Description of the Related Art

With respect to coating apparatuses for applying various sorts of coating liquids to a web of a thin metal plate, a paper, a plastic film and so forth, various kinds of apparatuses are known. For example, there are a roll coater, an air knife coater, a coater using a die, and a rod coater.

Among the coating apparatuses, the rod coater is widely utilized, since this coater is a simple coating apparatus and is capable of applying the various sorts of the coating liquids to various kinds of webs. As to the rod coaters, there are two types, in one of which an excess of the coating liquid applied to the web is removed by a coating rod (sometimes called as bar), and in the other of which application to the web and adjustment of a coating-liquid amount are performed by a single coating rod. In both types of the rod coaters, a surface of the coating rod has a plurality of grooves formed in a circumferential direction. In accordance with a depth, a width and so forth of the grooves, are regulated the coating-liquid amounts to be applied to the web and to be removed.

For example, Japanese Patent Laid-Open Publication No. 2001-901 proposes a coating rod having concave portions and convex portions, which are formed at a rod surface in a circumferential direction and are alternately formed in an axial direction of the rod. An upper surface of each convex portion is formed so as to be a flat surface, and a width of this flat surface is adapted to be 10 μm or more. At the same time, surface maximum roughness of the rod surface is 0.05 μm or more and is 0.8 μm or less, and a coating film of a hard material is formed on the rod surface having the above flat surface and the above surface maximum roughness.

In the meantime, Japanese Patent Laid-Open Publication No. 2001-87697 proposes a coating rod whose straightness is 0.25 mm or less per 1 m of the rod, for the purpose of uniform coating. Further, Japanese Patent Laid-Open Publication No. 9-1032 proposes a coating rod having improved abrasion resistance. Regarding this coating rod, uniform coating is formed in a widthdirection of a web in a state that a ratio of Rz to Rmax (Rz/Rmax) is within a range of 0.5 to 1.0, wherein Rz(μm) is the ten point average roughness of a cross section curve in a longitudinal direction of a rod surface and Rmax is maximum roughness. Moreover, a ratio of l to L (l/L) is within a range of 0.2 to 0.9, wherein l is a total length of line segments abutting on a material to be coated and L is a measurement length. Further, a peak number Pc of the cross section curve in the longitudinal direction is one or more per 1 mm.

In the above-mentioned coating rods, a surface reforming treatment layer is formed on the rod surface in order to improve the abrasion resistance. However, the surface of the treatment layer has minute irregularity of which the tip is sharp. Thus, if coating is performed as it is, there arises a problem in that scratches are caused on a coating surface.

Meanwhile, concavities and convexities for regulating a coating amount are formed on the rod surface. When the convexities have uneven height, there arises a problem in that the highest portion partially abuts on the web to cause scratches. Although the highest portion of the convexities of the rod surface is abraded while coating is performed, the highest portion causes the scratches in an initial stage of usage so that production efficiency is lowered. In the meantime, when the coating film having hardness and abrasion resistance is used, the sharp tip and the highest portion are hardly abraded so that the scratch is caused for a long time.

When the rod itself has deformation of curvature, roundness defect, torsion and so forth, thickness unevenness (hereinafter called as coating unevenness) is caused due to partial difference of a coating amount applied to the coating surface, even thought it is possible to perform coating. Thus, defective products occur at a certain rate.

Occurrence of the scratch and occurrence of the coating unevenness are unknown until a trial of coating is performed. Since the cost for the trial of coating is taken, countermeasure thereof is desired.

SUMMARY OF THE INVENTION

In view of the foregoing, it is a primary object of the present invention to provide a coating rod and a producing method therefor in which scratches and coating unevenness are prevented from occurring and a trial of coating is unnecessary.

In order to achieve the above and other objects, the producing method for the coating rod according to the present invention comprises a step of grinding the coating rod such that maximum height Ry of a rod surface is adjusted to 0.15 μm or less. The coating rod is a cylindrical rod for applying a coating liquid to a web successively transported. Alternatively, the coating rod is a cylindrical rod for removing an excess of the coating liquid applied to the web. The rod surface has circumferential concave portions and circumferential convex portions, which are alternately formed in an axial direction of the rod.

In a preferred embodiment, the coating rod is ground such that a ratio of D/W is 0.01 or more, wherein D is a total distance of the convex portions of the rod actually abutting on the web in the axial direction of the rod, and W is a coating width of the web. Further, the coating rod is ground such that a ratio of d/p is 0.01 or more, wherein p is a pitch of the convex portions in the axial direction of the rod, and d is a distance of a flat plane of the convex portion abutting on the web in the axial direction of the rod.

It is preferable to grind the coating rod such that straightness thereof is 30 μm or less per 1 m in the axial direction of the rod, and such that roundness thereof is 10 μm or less. Moreover, it is preferable to grind the coating rod such that a ratio of Sa1 to Sa2 is 99.5%, wherein Sa1 and Sa2 are cross-section areas perpendicular to the axial direction of the rod, and are respectively located at convex-portion positions a1 and a2 separating by an integral multiple of the pitch p. Grinding the coating rod is performed at a final step of a production process. In the final step, the grind is performed after forming a coating film of hard material. Forming this coating film and the grind may be alternately performed by several times.

According to the present invention, the coating rod is ground so as to put the various factors thereof within the following ranges. By the following (1) to (3), scratches of a coating surface are prevented from occurring. By the following (4) to (6), coating unevenness is prevented from occurring.

(1) The maximum height Ry of the rod surface is 0.15 μm or less.

(2) The ratio of D/W is 0.01 or more.

(3) The ratio of d/p is 0.01 or more.

(4) The straightness of the rod is 30 μm or less per 1 m in the rod-axis direction.

(5) The roundness of the rod is 10 μm or less.

(6) The ratio of Sa1/Sa2 is 99.5% or more.

BRIEF DESCRIPTION OF THE DRAWINGS

The above objects and advantages of the present invention will become apparent from the following detailed description of the preferred embodiments of the invention when read in conjunction with the accompanying drawings, in which:

FIGS. 4A and 4B are sectional views showing the further-enlarged surface of the coating rod, wherein FIG. 4A shows a state prior to grinding, and FIG. 4B shows a grinded state;

DETAILED DESCRIPTION OF THE PREFERRED EMBODIMENT(S)

Figure 1:
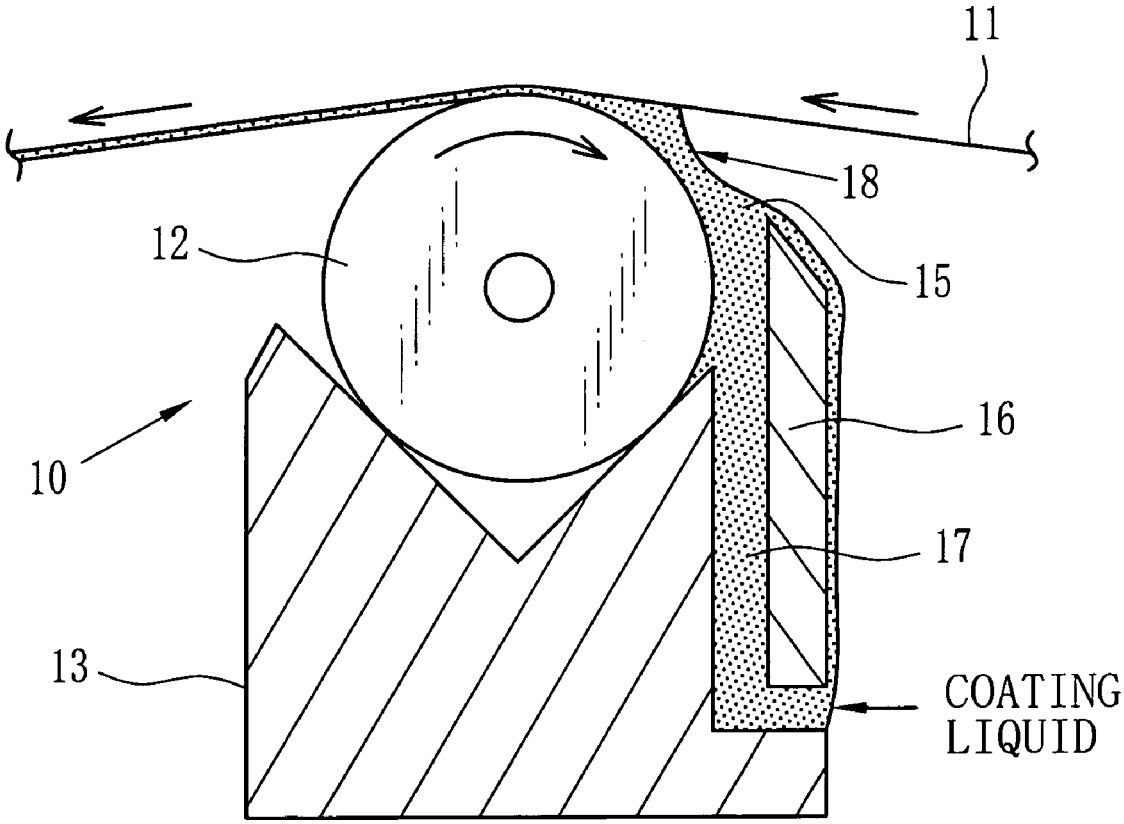
FIG. 1 is a schematic illustration showing a rod coater using a coating rod according to the present invention.

FIG. 1 shows a rod coater employing a coating rod according to the present invention. The rod coater 10 performs both of application to a web 11 and adjustment of a coating-liquid amount with the sole coating rod 12.

The coating rod 12 is disposed in a width direction of the web 11, abutting on the advancing web 11. The coating rod 12 is supported by a rod support block 13 so as to be rotatable. The coating rod 12 may be rotated in an identical direction with a web advancing direction. Otherwise, the coating rod 12 may be stationary and may be rotated in a reverse direction. In this embodiment, the coating rod 12 is rotated in the reverse direction to the web advancing direction so that it is possible to perform high-speed coating by increasing an advancement speed of the web 11.

The rod support block 13 prevents the coating rod 12 from curving, and at the same time, supplies a coating liquid 15 to the coating rod 12. The coating liquid 15 is supplied to a coating-liquid supply route 17, which is defined by the rod support block 13 and a weir member 16, to form a paddle 18 of the coating liquid 15 at a contact portion of the web 11 and the coating rod 12. The coating liquid 15 of the paddle 18 is applied to the web 11 by rotating the coating rod 12.

Figure 2:
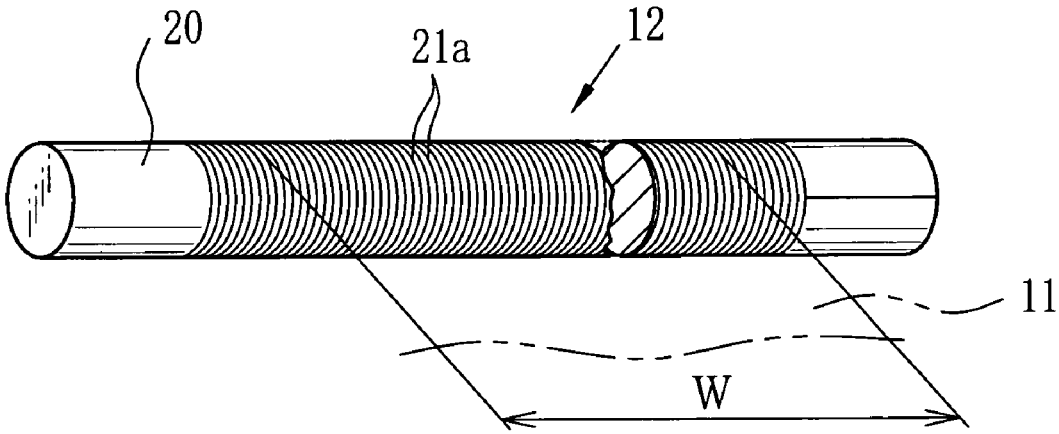
FIG. 2 is a perspective view showing a part of the coating rod.
Figure 3:
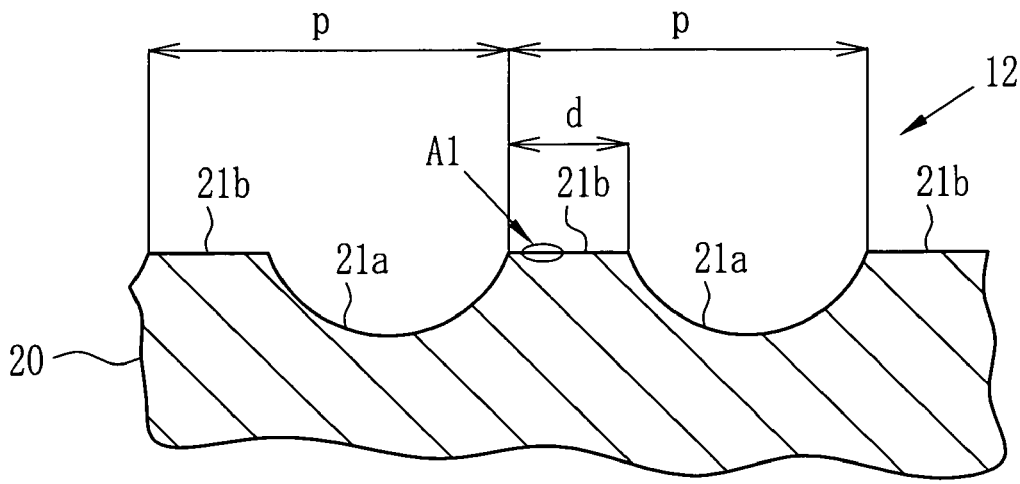
FIG. 3 is a sectional view showing an enlarged surface of the coating rod.

As shown in FIG. 2, the coating rod 12 is constituted of a cylindrical rod 20. A peripheral surface of the rod 20 has grooves (concave portions 21*a*) formed in a peripheral direction thereof and on almost the entire rod 20. The coating-liquid amount is adjusted by a depth, a width and a pitch P of the grooves. The many grooves are constituted of the circumferential concave portions 21*a* and circumferential convex portions 21*b*, which are formed on the rod surface and are alternately formed in an axial direction of the rod, such as shown in FIG. 3. An upper plane of the convex portion 21*b* is formed so as to be flat.

Figure 4A:
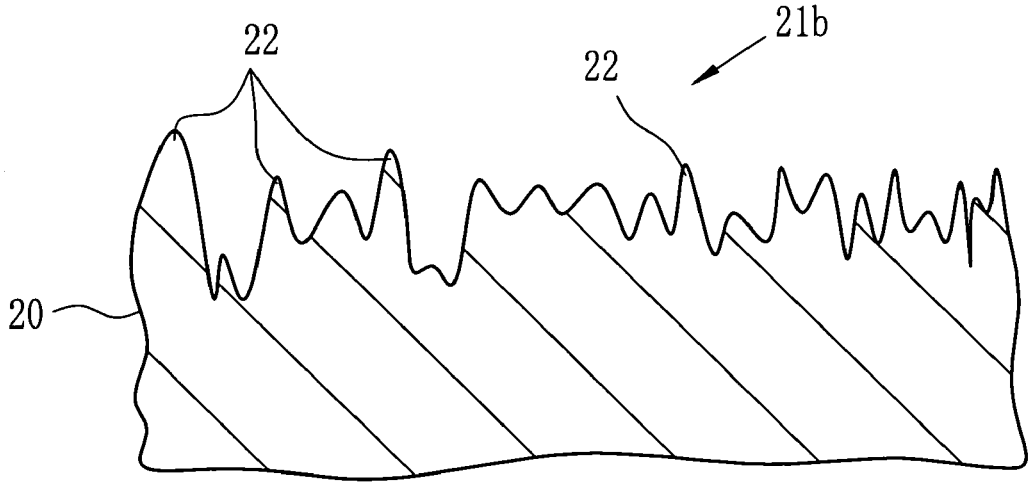

FIG. 4A is an enlarged sectional view showing a portion A1, which is a part of the convex portion 21*b* shown in FIG. 3. Micro-projections 22 exist on a surface of the convex portion 21*b*. When the coating rod 12 abuts on the web 11 such as shown in FIG. 1, the micro-projections 22 cause scratches on a coating surface. In this embodiment, in order to prevent the scratches from occurring, the micro-projections 22 are ground such that the maximum height Ry of the rod surface is 0.15 μm. When the maximum height Ry of the surface of the convex portion 21*b* exceeds 0.15 μm, the scratches occur on the coating surface. By the way, a lower limit of the maximum height Ry is not especially defined. However, when the maximum height Ry is less than 0.05 μm, it takes a long time for grinding so that operational efficiency is lowered. A subject area for regulating the maximum height Ry is the uppermost surface of the convex portion 21*b* abutting on the web 11. Since the other areas of the surface of the concave portion 21*a* and so forth do not abut on the web 11, it is unnecessary to consider the range of the above surface roughness.

Coating is usually performed under a constant pressure. When a contact area of the web 11 and the rod 20 is narrow, an excessive power is partially applied thereto and the scratches are caused on the coating surface. In order to prevent the scratches from occurring on the coating surface, grinding is performed such that a ratio of D/W becomes 0.01 or more, wherein D is a total of a distances d of the rod 20 actually abutting on the web 11 with the convex portions 21*b* in the axial direction of the rod, and W is a coating width of the web 11 (see FIG. 2). Moreover, in order to prevent the occurrence of the scratches, grinding is performed such that a ratio of d/p becomes 0.01 or more, wherein p is a pitch of the convex portions 21*b* in the axial direction of the rod 20, and d is the distance of the flat portion of the convex portion 21*b* abutting on the web 11 in the axial direction of the rod 20. It is preferable that D/W and d/p are 0.1 or more. Incidentally, when D/W and d/p are less than 0.01, the contact area of the web and the rod becomes narrow and the excessive power is partially applied to the rod to cause the scratches on the coating surface. In the present invention, although upper limits of D/W and d/p are not especially defined, these are defined in accordance with coating conditions of coating-liquid characteristics, a coating thickness and so forth.

In order to prevent the scratches from occurring on the coating surface such as described above, the coating rod 12 is ground at the final step so as to put the factors of the coating rod 12 within the predetermined range. As to a grinding method for the coating rod 12, various well-known methods may be used. It is preferable to use a grinding apparatus shown in FIG. 5.

In the meantime, if there is contact unevenness between the web 11 and the coating rod 12, coating unevenness is also caused as well as the scratches of the coating surface. The contact unevenness is caused due to accuracy of finished dimensions concerning a width direction and a rotational direction of the rod 12. In general, this is just a matter of time of producing the rod, and adjustment is impossible in a post-process. However, in case of minute deformation, it is possible to remove the deformation by grinding the coating rod 12. For this reason, the coating rod 12 is ground by using the grinding apparatus shown in FIG. 5.

By grinding the coating rod 12, straightness thereof is put in a range of 30 μm or less per 1 m in the axial direction of the rod 20, and roundness thereof is put in a range of 10 μm or less, and a ratio of Sa1 to Sa2 is put in a range of 99.5% or more, wherein Sa1 and Sa2 are cross-section areas perpendicular to the axial direction of the rod 20. The cross-section areas Sa1 and Sa2 are respectively located at convex-portion positions a1 and a2 separating by an integral multiple of the pitch p. It is preferable that the cross-section ratio Sa1/Sa2 is 99.9% or more.

Figure 5:
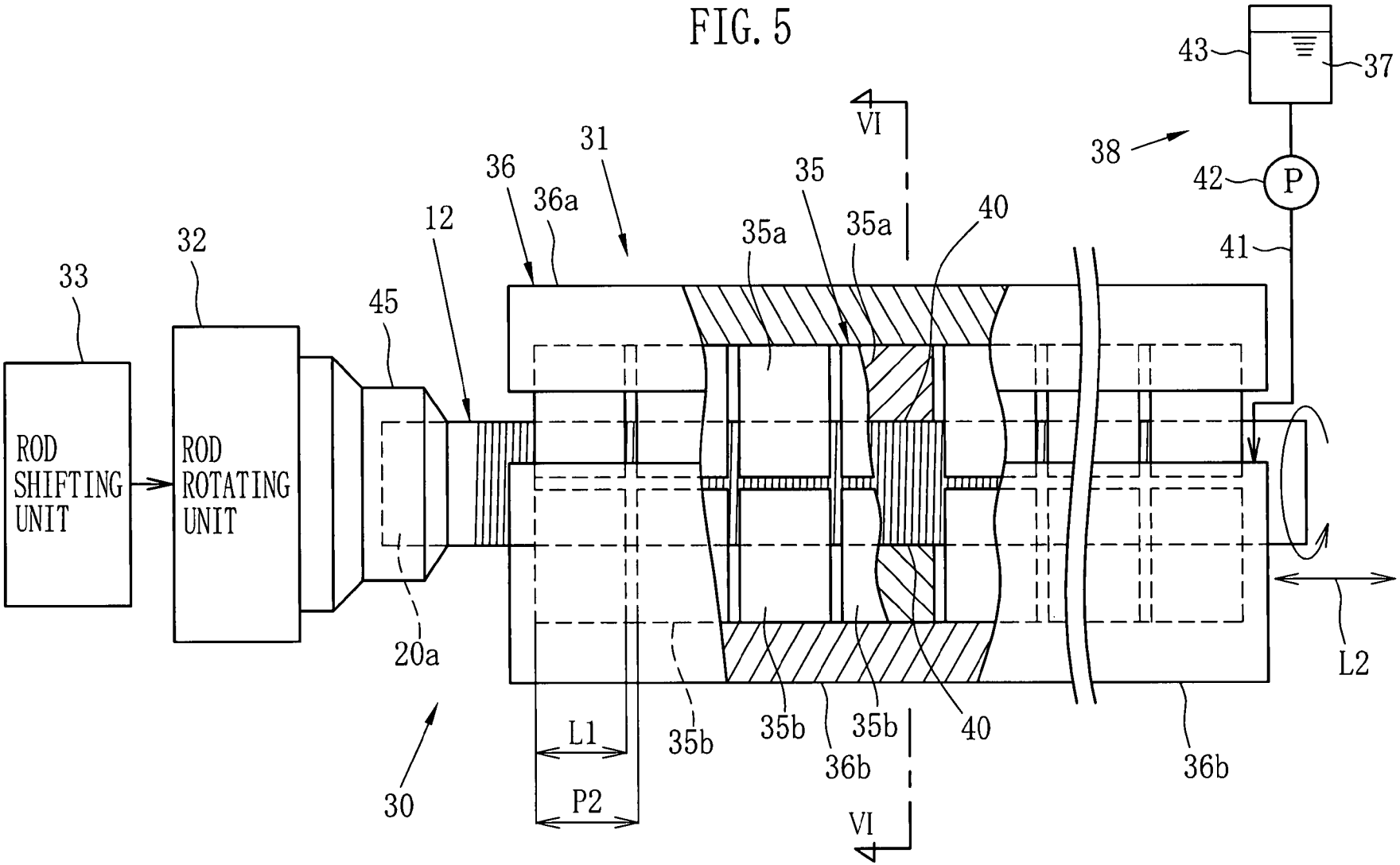
FIG. 5 is a schematic illustration showing an example of a grinding apparatus for the coating rod.
Figure 6:
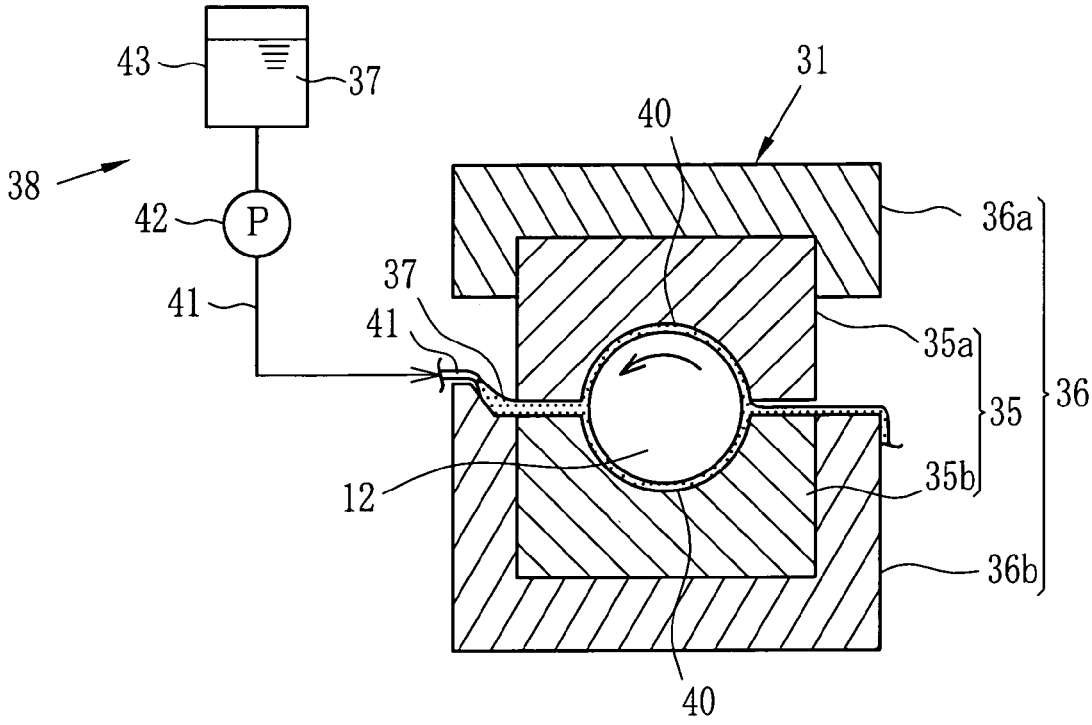
FIG. 6 is a sectional view taken along a line VI-VI in FIG. 5.

FIGS. 5 and 6 show the grinding apparatus 30 comprising a grinding unit 31, a rod rotating unit 32 and a rod shifting unit 33. The grinding unit 31 is constituted of a plurality of wrappers 35, a holder 36 for holding the wrappers 35, and an abrasive supplier 38. The wrapper 35 holds the coating rod 12 so as to cover it in a vertical direction. The abrasive supplier 38 supplies an abrasive 37 to a space between the wrapper 35 and the rod 20.

The wrapper 35 is vertically divided into two parts and is constituted of an upper wrapper body 35*a* and a lower wrapper body 35*b*. The wrappers 35 are disposed in the holder 36 so as to be arranged in the axial direction of the coating rod 12. Each of the wrapper bodies 35*a* and 35*b* is formed with a grinding surface 40, which is an inner circumferential surface having a diameter substantially same with that of the coating rod 12. The wrapper 35 has a length L1, which is 80 mm for example, in the rod-axis direction. For instance, the wrappers, a number of which is twenty-five, are arranged side by side. The number of the wrappers 35 to be used is determined in accordance with the coating width of the coating rod 12 and the distance of the convex-portion area in the rod-axis direction. By the way, in the drawing, gaps are provided between the respective wrappers 35 for the purpose of clarification. However, as a matter of fact, the wrappers are arranged without the gaps. The gaps may be provided as need arises.

The upper wrapper body 35*a* is retained by an upper support 36*a* and is urged toward the coating rod 12 by its own weight. The lower wrapper body 35*b* is retained by a lower support 36*b*. The wrapper 35 is made of cast iron, copper alloy, plastic compound and so forth.

The abrasive supplier 38 includes a supply pipe 41 and a pump 42 to supply the abrasive 37 from an abrasive supply tank 43 to the grinding surface 40 of the wrapper 35. As to the abrasive, are used iron oxide, aluminum oxide, pumice and so forth.

As shown in FIG. 5, the rod rotating unit 32 holds one end 20 a of the rod 20 with a chuck 45 to rotate it. The rod shifting unit 33 reciprocates the rod 20 and the rod rotating unit 32 in the axial direction of the rod 20. A shift amount L2 of the reciprocation is larger than a pitch P2 of the respective wrappers 35. Grinding is performed by the different grinding surfaces 40 so that the coating rod 12 is uniformly ground.

At the time of grinding, the coating rod 12 is set first to the grinding surface 40 of the wrapper 35. And then, the one end 20*a* of the coating rod 12 is held by the chuck 45. Successively, the abrasive supplier 38 is driven to supply the abrasive (lapping compound) 37 to the grinding surfaces 40 of the respective wrappers 35. After that, the rod 20 is rotated and the rod shifting unit 33 reciprocates the rod rotating unit 32 and the rod 20 in the axis direction of the rod by the shift amount L2. Owing to this, the convex portions 21*b* of the coating rod 12 are levelly ground. Further, various factors of the coating rod are put in the following ranges (1) to (6).

(1) The maximum height Ry of the rod surface is 0.15 μm or less.

(2) The ratio of D/W is 0.01 or more.

(3) The ratio of d/p is 0.01 or more.

(4) The straightness of the rod is 30 μm or less per 1 m in the axis direction of the rod.

(5) The roundness of the rod is 10 μm or less.

(6) The ratio of Sa1/Sa2 is 99.5% or more.

Figure 4B:
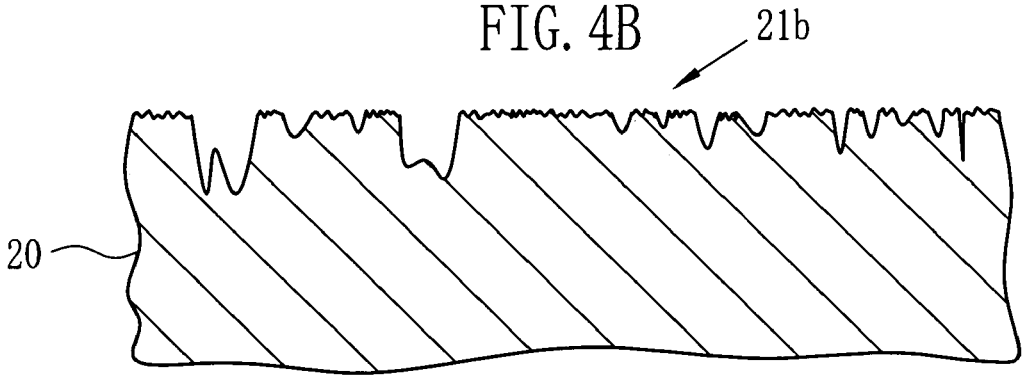

In order to automatically judge whether or not the respective factors are within the above-noted ranges, grinding time and variations of the respective factors, for example, are predetermined every classification of the coating rod and it is judged on the basis of the grinding time whether or not the respective factors reach the prescribed values. FIG. 4B is an enlarged sectional view showing an example of the ground convex portion 21*b*. The micro-projections shown in FIG. 4A are removed.

Although the coating rod is made of stainless steel, it is preferable that a coating film of a hard material is formed on the surface of the rod. This coating film is formed by utilizing a method of wet coating, dry coating of spattering coating and so forth, alternatively by utilizing a method of plating and so forth. It is possible to use coating films of hard chrome plating and amorphous chrome plating. It is also possible to use super-hard coating films of a ceramic coating film and a diamond coating film. Otherwise, a coating film of hard plastic may be formed. Meanwhile, in the above embodiment, grinding is performed at the final step after coating. However, coating and grinding may be alternately repeated by several times to put the factors in the above ranges (1) to (6). Such a method is included in the present invention.

As to a processing method for directly forming the concave portion 21*a* and the convex portion 21*b* on the surface of the rod 20, there are a cutting method, a component rolling method, a laser processing method and so forth. Especially, the component rolling method using plural dice is preferably utilized.

Besides the grinding apparatus 30 shown in FIGS. 5 and 6, it is possible to use another grinding apparatus in which a coating rod is set to a groove, which is formed on a support and has a V-shaped cross section. In this grinding apparatus, the rod is rotated and grinding is performed by pressing a grinding member against convex portions of the rotating rod. Incidentally, as the grinding member, are used a grind stone, an endless grind sheet, a feeder-type grind sheet, an abrasive (lapping compound) to be supplied between an endless belt and the coating rod, and so forth. The abrasive is constituted of abrasive grains and a lap liquid. The abrasive grain is made of fused alumina and has optional grain size and hardness. The lap liquid is made by mixing light oil, spindle oil, machine oil, water and so forth. The abrasive is used in a liquid state or in a paste state. It is preferable that the abrasive is shifted on an X-Y plane having an axial direction X and a direction Y perpendicular to the axial direction X. This shift is automatically performed by using a shifting mechanism, but may be manually performed by an operator. With respect to the support, the exclusive support for grinding is used. However, the coating rod may be attached to a coating head and grinding may be performed with the grinding apparatus 30 for the coating rod attached to the coating head.

Figure 7:
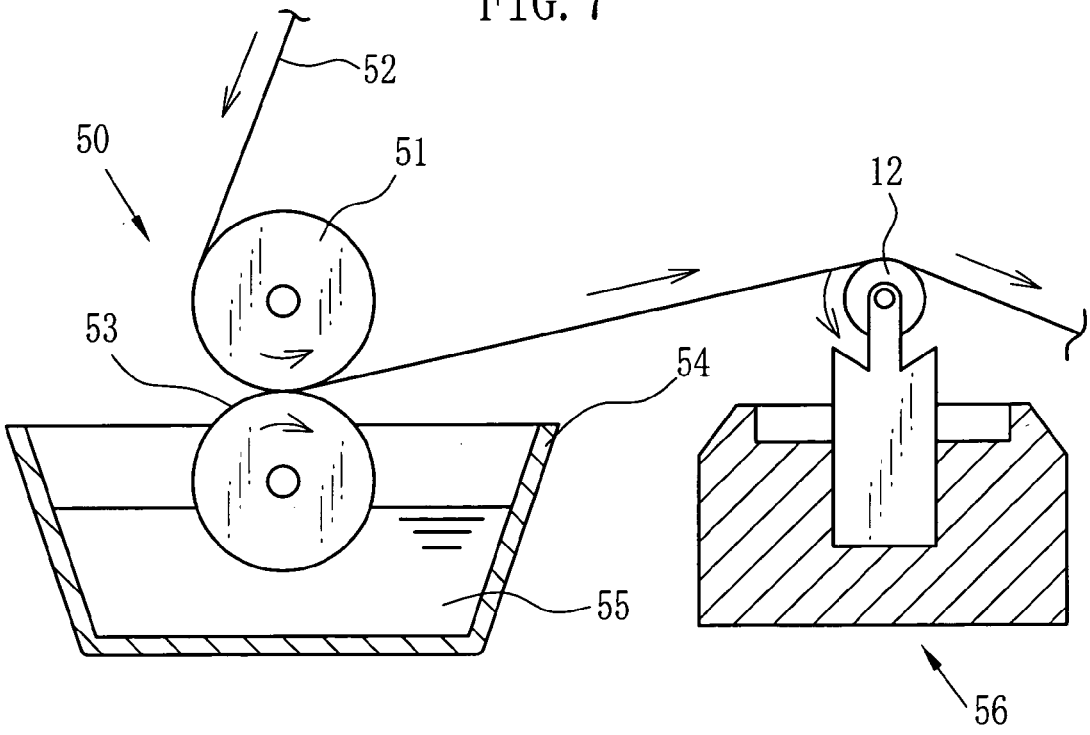
FIG. 7 is a schematic illustration showing a coating apparatus in which the coating rod according to the present invention is used as a member for removing an excess of a coating liquid.

In the meantime, a roll coater 50 shown in FIG. 7 may employ the coating rod according to the present invention. In this roll coater 50, a web 52 is supported by a backup roller 51 to advance. By rotating a coating roller 53, a coating liquid 55 contained in a coating-liquid pan 54 is picked up relative to the advancing web 52. The picked-up coating liquid 55 is applied to the web 52. The web 52 to which the coating liquid 55 has been applied reaches a rod coater 56 before the coating liquid is dried and solidified. And then, a coating surface of the web 52 abuts on the coating rod 12 rotating in a reverse direction to an advancing direction of the web 52. In virtue of this, an excess of the coating liquid 55 applied to the web 52 is removed by the coating rod 12 to regulate a coating-liquid amount of the web 52. An amount of the coating liquid 55 to be removed is controlled by changing a depth and a width of the groove (concave portion) 21 a formed on the coating rod 12, and by changing pitches of the concave portions 21*a* and the convex portions 21*b*.

With respect to the webs 11 and 52 used in the present invention, it is possible to use not only the strip type but also a sheet type. It is also possible to use a thin metal plate of aluminum and so forth, a paper, a plastic film, a resin coating paper, a synthetic paper and so forth. As a material of the plastic film, are used for instance polyolefin of polyethylene, polypropylene and so forth, vinyl polymer of polyvinyl acetate, polyvinyl chloride, polystyrene and so forth, polyamide of 6,6-nylon, 6-nylon and so forth, polyester of polyethylene terephthalate, polyethylene-2, 6-naphthalate and so forth, and cellulose acetate of polycarbonate, cellulose triacetate, cellulose diacetate and so forth. Further, as to a resin to be used for the resin coating paper, polyolefin including polyethylene is representative. However, this is not exclusive. Although the thicknesses of the webs 11 and 52 are not especially limited, the thickness of 0.01 mm to 1.0 mm is advantageous in terms of handling and versatility.

EXAMPLE 1

The concave portions 21*a* and the convex portions 21*b* were formed on the surface of the stainless-steel rod 20 by the component rolling method, such as shown in FIG. 3. This rod 20 for which hard chrome-plating of 12 μm was carried out was ground by the grinding apparatus 30 at the final step to produce the coating rod 12 having the following factors. This coating rod 12 was attached to the rod coater 10 shown in FIG. 1, and the web was advanced at a line speed of 90 m/min. And then, coating was performed by rotating the rod 20 at a peripheral velocity of 1 m/min in a reverse direction to the web advancement direction. After drying the web, samples of Nos. 1 to 8 were obtained. The coating surfaces of the samples of Nos. 1 to 8 were visually observed to estimate the scratches and the coating unevenness. Experimental results of this example are shown in Table 1.

TABLE 1

| No. | Ry [μm] | D/W | ST [μm] | RO [μm] | Sa1/Sa2 [%] | Judgment Result of Coating Surface |
|---|---|---|---|---|---|---|
| 1 | 0.2 | 0.005 | 50 | 20 | 80 | Scratches of whole area<br>Heavy Coating Unevenness |
| 2 | 0.2 | 0.01 | 50 | 20 | 99.5 | Scratches of whole area<br>Heavy Coating Unevenness |
| 3 | 0.1 | 0.01 | 50 | 10 | 99.5 | Mid Coating Unevenness |
| 4 | 0.1 | 0.005 | 30 | 10 | 99.5 | Partial Scratches |
| 5 | 0.1 | 0.01 | 30 | 10 | 99.5 | No scratch<br>No Coating Unevenness |
| 6 | 0.1 | 0.01 | 30 | 10 | 80 | Weak Coating Unevenness |
| 7 | 0.1 | 0.01 | 30 | 20 | 80 | Heavy Coating Unevenness |
| 8 | 0.1 | 0.01 | 30 | 20 | 99.5 | Mid Coating Unevenness |

In Table 1, ST represents straightness per 1 m and RO represents roundness.

As will be apparent from Table 1, the scratches are caused due to the maximum height Ry and D/W, and the coating unevenness is caused due to the straightness, the roundness and Sa1/Sa2. The scratches occur when the maximum height Ry is 0.2, and the partial scratches occur when D/W is 0.005. In consideration of this, it is known that the scratches are prevented from occurring when the maximum height Ry is 0.1 μm or less and D/W is 0.01 or more.

By comparing the samples of Nos. 5 and 6, it is known that the weak coating unevenness occurs when Sa1/Sa2 is 80%. Further, by comparing the samples of Nos. 5, 7 and 8, it is known that the coating unevenness is caused when the roundness is 20 μm.

EXAMPLE 2

The concave portions 21*a* and the convex portions 21*b* were formed on the surface of the stainless-steel rod 20 by the component rolling method. This rod 20 for which hard chrome-plating of 12 μm was carried out was ground at the final step to produce the coating rod 12 having the following factors. This coating rod 12 was attached to the rod coater 10 shown in FIG. 1, and the web was advanced at a line speed of 60 m/min. And then, coating was performed by rotating the rod 20 at a peripheral velocity of 60 m/min in the same direction with the web advancement direction. After drying the web, samples of Nos. 11 to 18 were obtained. The coating surfaces of the samples of Nos. 11 to 18 were visually observed to estimate the scratches and the coating unevenness. Experimental results of this example are shown in Table 2. In Example 2, the web advancement speed is identical with the peripheral velocity of the rod, and the web advancement direction is the same with the rotational direction of the rod. Thus, the scratches are prevented from being caused by the micro-projections. However, there is a disadvantage that high-speed coating is detracted. The coating unevenness occurs even when the roundness is 10 μm. As will be known from the sample of No. 18, there is no coating unevenness when the roundness is 5 μm.

TABLE 2

| No. | Ry [μm] | D/W | ST [μm] | RO [μm] | Sa1/Sa2 [%] | Judgment Result of Coating Surface |
|---|---|---|---|---|---|---|
| 11 | 0.2 | 0.02 | 50 | 20 | 80 | Heavy Coating Unevenness |
| 12 | 0.2 | 0.01 | 50 | 20 | 99.5 | Heavy Coating Unevenness |
| 13 | 0.1 | 0.01 | 50 | 10 | 99.5 | Mid Coating Unevenness |
| 14 | 0.2 | 0.01 | 30 | 10 | 99.5 | Mid Coating Unevenness |
| 15 | 0.1 | 0.01 | 30 | 10 | 80 | Weak Coating Unevenness |
| 16 | 0.1 | 0.01 | 30 | 20 | 80 | Heavy Coating Unevenness |
| 17 | 0.1 | 0.01 | 30 | 20 | 99.5 | Mid Coating Unevenness |
| 18 | 0.1 | 0.01 | 30 | 5 | 99.5 | No Coating Unevenness |

Also in Table 2, ST represents straightness per 1 m and RO represents roundness.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A coating rod which is a cylindrical rod for performing at least one of applying a coating liquid to a continuously-fed web and removing an excess of the coating liquid applied to said web, said coating rod comprising:

circumferential concave portions formed on a rod surface of said coating rod; and circumferential convex portions formed on said rod surface, said concave portions and said convex portions being alternately formed in an axial direction of said rod, wherein a ratio of Sa1 to Sa2 is 99.5% or more, where Sa1 and Sa2 are cross-section areas perpendicular to the axial direction of said rod, and are respectively located at convex-portion positions a1 and a2 separating by an integral multiple of a pitch p of said convex portions in said axial direction; and wherein a maximum height Ry of said rod surface is 0.15 μm or less and/or a plane of said rod surface abutting on said web has a maximum height Ry of 0.15 μm or less.

* * * * *